US008960088B2

(12) United States Patent
Lee et al.

(10) Patent No.: US 8,960,088 B2
(45) Date of Patent: Feb. 24, 2015

(54) GRAVURE PRINTING METHOD

(75) Inventors: Youngu Lee, Suwon-si (KR); Kyu-Young Kim, Suwon-si (KR); Nam-Ok Jung, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 956 days.

(21) Appl. No.: 12/858,093

(22) Filed: Aug. 17, 2010

(65) Prior Publication Data

US 2011/0107927 A1 May 12, 2011

(30) Foreign Application Priority Data

Nov. 9, 2009 (KR) ..... 10-2009-0107653

(51) Int. Cl.
*B41M 1/10* (2006.01)
*B41F 3/36* (2006.01)
*B41F 3/81* (2006.01)

(52) U.S. Cl.
CPC .. *B41M 1/10* (2013.01); *B41F 3/36* (2013.01); *B41F 3/81* (2013.01)
USPC ..... 101/170; 101/158

(58) Field of Classification Search
None
See application file for complete search history.

(56) References Cited

U.S. PATENT DOCUMENTS

2004/0231781 A1* 11/2004 Bao et al. ..... 156/230
2008/0236425 A1* 10/2008 Takamatsu ..... 101/453

FOREIGN PATENT DOCUMENTS

| | | | |
|---|---|---|---|
| JP | 3021695 | B | 1/2000 |
| JP | 2001-305724 | A | 11/2001 |
| JP | 3522450 | B | 2/2004 |
| JP | 2008-000929 | A | 1/2008 |
| JP | 4200178 | A | 10/2008 |
| JP | 2009-072997 | A | 4/2009 |
| KR | 1020010043296 | A | 5/2001 |
| KR | 10465731 | B1 | 12/2004 |
| KR | 1020070051004 | A | 5/2007 |
| KR | 10773044 | B1 | 10/2007 |
| KR | 1020080001949 | A | 1/2008 |
| KR | 1020080024316 | A | 3/2008 |
| KR | 10878028 | B1 | 1/2009 |
| KR | 1020090047687 | A | 5/2009 |

* cited by examiner

*Primary Examiner* — Joshua D Zimmerman
(74) *Attorney, Agent, or Firm* — Innovation Counsel LLP

(57) ABSTRACT

A gravure printing method is provided that includes: patterning a substrate to form a printing substrate having a recess portion and a convex portion; forming a first self-assembled monolayer on the surface of the recess portion; forming a second self-assembled monolayer on the surface of the convex portion; filling ink into the recess portion; and transferring the ink filled in the recess portion to a printing object substrate, wherein the first and second self-assembled monolayers respectively formed on the surfaces of the recess portion and the convex portion have different surface energies.

21 Claims, 6 Drawing Sheets

GRAVURE PRINTING METHOD

CROSS-REFERENCE TO RELATED APPLICATION

This application claims priority to and the benefit of Korean Patent Application No. 10-2009-0107653 filed in the Korean Intellectual Property Office on Nov. 9, 2009, the entire contents of which are incorporated herein by reference.

BACKGROUND OF THE INVENTION (a) Field of the Invention

The present invention relates to a printing device and a gravure printing method using the same.

(b) Description of the Related Art

Lithography is a patterning technique that is used for microfabrication. Commonly used lithography techniques include photolithography, electron-beam lithography, and X-ray lithography, all of which utilize optics or a beam. In the lithography process a photoresist, which is a material that reacts upon irradiation with light, and an etching process, are used to form a pattern. Accordingly, lithography can be a complicated process, and increases the cost of the device and the manufacturing time.

As electronic parts have become smaller and more highly integrated, interest in improved patterning techniques that are suitable for the new size and functions of the elements in the electronic devices has increased.

Printing processes have many merits in terms of simplicity and low cost, as compared to lithography. For instance, gravure offset printing is capable of accurately printing a pattern with a microsize, and is thus an excellent printing process method. In liquid crystal display devices, and also organic electroluminescent devices used in flat panel displays, various patterns such as metal wiring, semiconductors, pixels, color filters, column spacers, and insulating layers may be formed through a printing process.

The above information disclosed in this Background section is only for enhancement of understanding of the background of the invention and therefore it may contain information that does not form the prior art that is already known to a person of ordinary skill in the art.

SUMMARY OF THE INVENTION

The present invention provides a printing device and a gravure printing method using the same to increase accuracy of a printing pattern.

A gravure printing method includes: patterning a substrate to form a printing substrate having a recess portion and a convex portion; forming a first self-assembled monolayer on the surface of the recess portion; forming a second self-assembled monolayer on the surface of the convex portion; filling the recess portion with an ink; and transferring the ink in the recess portion to a printing object substrate, wherein the first and second self-assembled monolayers respectively formed on the surfaces of the recess portion and the convex portion have different surface energies.

The forming of the first self-assembled monolayer on the surface of the recess portion may include forming a first hydroxyl group on the surface of the recess portion and combining the first hydroxyl group and a compound including a hydrophilic group, and the forming the second self-assembled monolayer on the surface of the convex portion may include forming a second hydroxyl group on the surface of the convex portion surface and combining the second hydroxyl group and a compound including a hydrophobic group.

The ink may include a polar solvent.

The forming of the first hydroxyl group may include using one of UV (ultraviolet)/ozone, plasma, a basic solution, and an acidic solution, and the forming of the second hydroxyl group may include using a basic solution.

The compound including the hydrophilic group may include at least one of trichlorosilane, dichloro-monomethylsilane, and monochloro-dimethylsilane substituted with the hydrophilic group, and the hydrophilic group including at least one of a glycol, an alcohol, and an amine.

The compound including the hydrophobic group may include at least one of trichlorosilane, dichloro-monomethylsilane, and monochloro-dimethylsilane substituted with the hydrophobic group, the hydrophobic group including an alkyl or aromatic group.

The forming of the first self-assembled monolayer on the surface of the recess portion may include forming a first hydroxyl group on the surface of the recess portion and combining the first hydroxyl group and a compound including the hydrophobic group, and the forming of the second self-assembled monolayer on the surface of the convex portion may include forming a second hydroxyl group on the surface of the convex portion surface and combining the second hydroxyl group and the compound including the hydrophilic group.

The ink may include a non-polar solvent.

The forming of the first hydroxyl group may include using one of UV (ultraviolet)/ozone, plasma, a basic solution, and an acidic solution, and the forming of the second hydroxyl group may include using a basic solution.

The compound including the hydrophilic group may include at least one of trichlorosilane, dichloro-monomethylsilane, and monochloro-dimethylsilane substituted with the hydrophilic group, the hydrophilic group including at least one of a glycol, an alcohol, and an amine.

The compound including the hydrophobic group may include at least one of trichlorosilane, dichloro-monomethylsilane, and monochloro-dimethylsilane substituted with the hydrophobic group, the hydrophobic group including an alkyl or aromatic group.

The patterning of the substrate to form the printing substrate may include forming a photoresist pattern on a portion of the substrate corresponding to the convex portion.

The forming of the first self-assembled monolayer on the surface of the recess portion may be executed in a state in which the photoresist pattern is present on the substrate.

The filling the recess portion with ink may include injecting the ink into the recess portion, and removing the ink disposed in regions of the substrate other than the recess portion by using a blade.

The transferring of the ink in the recess portion to the printing object substrate may include rotating a blanket at the surface of the printing substrate to transfer the ink filled in the recess portion to the blanket, and transferring the ink transferred to the blanket from the blanket to a printing object substrate.

In another aspect, a printing device includes a printing substrate including a recess portion and a convex portion, an ink injection device having a nozzle to fill the recess portion with an ink, and a blanket that transfers the ink filled in the recess portion to the printing object substrate. The surface of the recess portion is formed with a hydrophilic self-assembled monolayer or a hydrophobic self-assembled monolayer.

The surface of the convex portion is formed with the hydrophobic self-assembled monolayer or the hydrophilic self-assembled monolayer, and the self-assembled monolayers formed on the surfaces of the recess portion and the convex portion have different surface energies.

A blade for planarizing the ink in the recess portion and removing the ink remaining on the convex portion may be further included.

The hydrophilic self-assembled monolayer may be combined with the hydroxyl group positioned on the surface of the recess portion or the convex portion surface, and a compound including the hydrophilic group or the hydroxyl group.

The compound including the hydrophilic group may include at least one of trichlorosilane, dichloro-monomethylsilane, and monochloro-dimethylsilane substituted with the hydrophilic group, the hydrophilic group including at least one of a glycol, an alcohol, and an amine.

The compound including the hydrophobic group may include at least one of trichlorosilane, dichloro-monomethylsilane, and monochloro-dimethylsilane substituted with the hydrophobic group, the hydrophobic group including an alkyl or aromatic group.

The concave region and the convex region of the printing substrate are surface-treated to have different surface energies such that the accuracy of the printing pattern may be improved.

DESCRIPTION OF REFERENCE NUMERALS INDICATING PRIMARY ELEMENTS IN THE DRAWINGS

Figure 1:
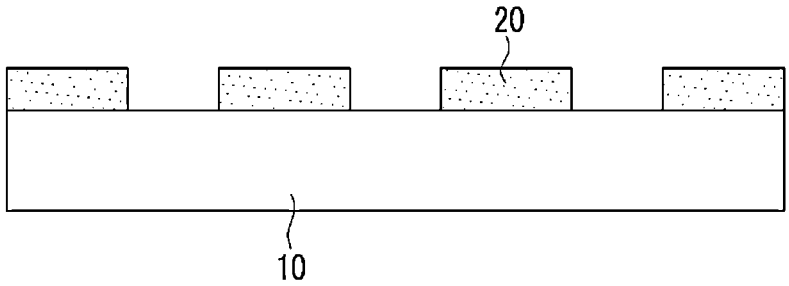
FIGS. 1 to 8 are cross-sectional views showing a gravure printing method according to an exemplary embodiment.

| | | | |
|---|---|---|---|
| 10 | substrate | 20 | photoresist pattern |
| 30 | recess portion | 35 | convex portion |
| 40, 50 | self-assembled monolayer | 55 | printing substrate |
| 60 | blade | 70 | ink |
| 80 | blanket | 100 | printing object substrate |

DETAILED DESCRIPTION OF THE EMBODIMENTS

The present invention will be described more fully hereinafter with reference to the accompanying drawings, in which exemplary embodiments are shown. As those skilled in the art would realize, the described embodiments may be modified in various different ways, all without departing from the spirit or scope of the present invention.

In the drawings, the thickness of layers, films, panels, regions, etc., are exaggerated for clarity. It will be understood that when an element such as a layer, film, region, or substrate is referred to as being "on" another element, it can be directly on the other element or intervening elements may also be present. Like reference numerals designate like elements throughout the specification.

FIGS. 1 to 8 are cross-sectional views showing a gravure printing method according to an exemplary embodiment.

Referring to FIG. 1, a photoresist pattern 20 is formed on a substrate 10 made of glass.

Figure 2:
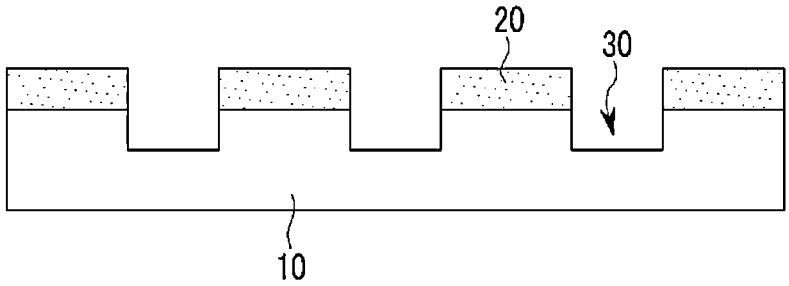

Referring to FIG. 2, the substrate 10 is etched by using the photoresist pattern 20 as a mask and using hydrogen fluoride (HF) to etch glass substrate 10 to form recess portions 30 with a depth of several microns. The recess portions 30 are recessed to a predetermined depth, and the width, the length, and the depth of the recess portions 30 may be formed to be substantially the same as or to be larger than the width, the length, and the depth of the desired pattern to be made in the printing process. Also, the recess portions 30 may be formed to correspond to the arrangement of the desired pattern.

Figure 3:
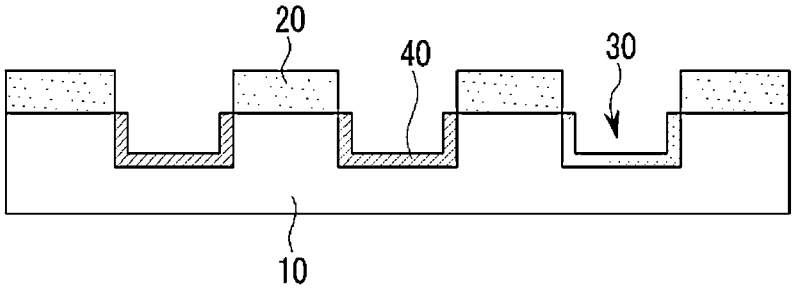

Referring to FIG. 3, a hydrophilic or hydrophobic self-assembled monolayer 40 is formed on the surface of the exposed recess portion 30 in a state in which the photoresist pattern 20 is not removed from substrate 10. Whether a hydrophilic or hydrophobic self-assembled monolayer 40 is used depends on the ink to be filled into the recess portions 30. When the ink to be filled in the recess portion 30 includes a polar solvent, a hydrophilic self-assembled monolayer 40 is formed on the surface of the recess portion 30. On the other hand, when the ink to be filled in the recess portion 30 includes a non-polar solvent, a hydrophobic self-assembled monolayer 40 is formed on the surface of the recess portion 30.

A method for forming the hydrophilic self-assembled monolayer 40 on the surface of the recess portion 30 will be described.

First, the surface of the recess portion 30, which is not covered by the photoresist pattern 20, is treated by using one of UV (ultraviolet)/ozone, plasma, a basic solution, or an acidic solution to form a hydroxyl group at the surface of substrate 10 in the recess portion 30.

Next, the hydroxyl group of the surface of the recess portion 30 is reacted by using at least one of trichlorosilane, dichloro-monomethylsilane, and monochloro-dimethylsilane including a hydrophilic group. These compounds, which have a hydrophilic group, form a strong covalent bond with the hydroxyl group of the surface of the substrate 10 in recess portion 30. The degree of hydrophilicity of the surface of the substrate in the recess portion 30 may be controlled according to the polarity of the hydrophilic group that is used.

The hydrophilic group may include, for example, an organic functional group having high polarity such as a glycol, an alcohol, an amine or carboxylic acid.

Next, a method for forming the hydrophobic self-assembled monolayer 40 on the surface of the recess portion 30 will be described.

First, the surface of the recess portion 30, which is not covered by the photoresist pattern 20, is treated by using one of UV (ultraviolet)/ozone, plasma, a basic solution, or an acidic solution to form a hydroxyl group at the surface of the substrate 10 in the recess portion 30.

Next, the hydroxyl group at the surface of the substrate 10 in the recess portion 30 is reacted by using at least one of trichlorosilane, dichloro-monomethylsilane, and monochloro-dimethylsilane, and each including a hydrophobic group, such as an alkyl or aromatic group. Here, the compounds, which have a hydrophobic group, form a strong covalent bond with the hydroxyl group of the surface of the recess portion 30. The degree of hydrophobicity of the surface of the recess portion 30 may be controlled through the chain length of the alkyl group in the hydrophobic group included in the compound, and the kind of functional group that is used.

Figure 4:
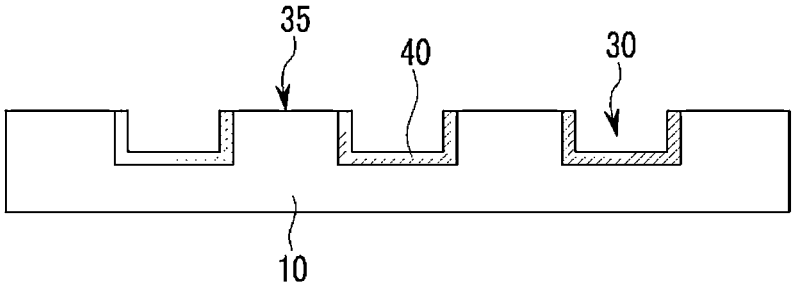
Figure 5:
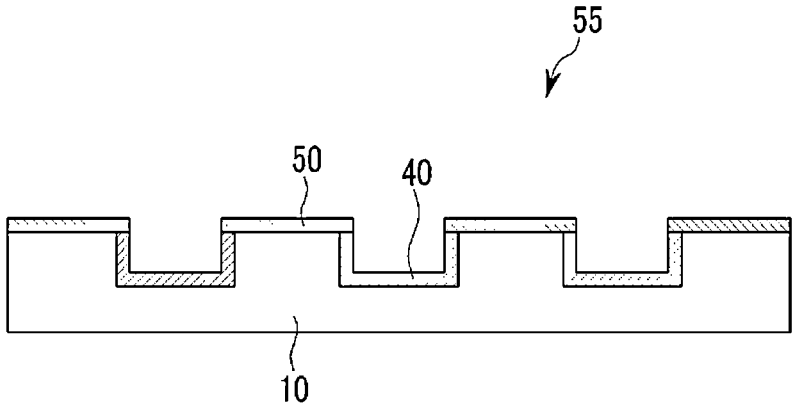

Referring to FIG. 4 and FIG. 5, by removing the photoresist pattern 20, a portion that the photoresist pattern 20 occupies on the substrate 10 is defined as a convex portion 35. The convex portion 35 is a portion of substrate 10 that is relatively protruded as compared with the recess portion 30.

A hydrophilic or hydrophobic self-assembled monolayer 50 is formed on the convex portion 35. Whether a hydrophilic or hydrophobic self-assembled monolayer 50 is used, depends on the ink to be filled into the recess portions 30. In detail, when the ink to be filled in the recess portion 30 includes a polar solvent, the hydrophobic self-assembled monolayer 50 is formed on the surface of the convex portion 35. When the ink to be filled in the recess portion 30 includes a non-polar solvent, the hydrophilic self-assembled monolayer 50 is formed on the surface of the convex portion 35.

A method for forming the hydrophilic self-assembled monolayer 40 on the surface of the convex portion 35 will now be described.

In the present step, the photoresist pattern 20 has been removed from substrate 10. When forming a hydroxyl group at the surface of the convex portion 35, care must be used to prevent unintended modification of the hydrophobic self-assembled monolayer 40 previously formed at the surface of the substrate 10 in the recess portion 30. Use of treatments such as UV (ultraviolet)/ozone, plasma, and an acidic solution, which may be used in the formation of the hydroxyl group at the surface of substrate 10 in the recess portion 30, may modify self-assembled monolayer 40.

Accordingly, a basic solution that does not modify the self-assembled monolayer 40 formed on the surface of substrate 10 in the recess portion 30 is used to form the hydroxyl group on the surface of the convex portion 35.

Next, the hydroxyl group of the surface of the convex portion 35 is reacted by using at least one of trichlorosilane, dichloro-monomethylsilane, and monochloro-dimethylsilane, and each including a hydrophilic group. Here, the compounds, which have the hydrophilic group, form a strong covalent bond with the hydroxyl group of the surface of the convex portion 35. The degree of hydrophilicity of the surface of the substrate 10 at the convex portion 35 may be controlled according to the polarity of the hydrophilic group that is used.

The hydrophilic group may include, for example, an organic functional group having high polarity such as a glycol, an alcohol, or an amine.

Next, a method for forming the hydrophobic self-assembled monolayer 40 on the surface of the substrate 10 at the convex portion 35 will be described.

As described above with respect to formation of the hydrophilic self-assembled monolayer 50 on the surface of substrate 10 at the convex portion 35, the hydroxyl group is formed on the surface of the substrate 10 at the convex portion 35 by using the basic solution to avoid modification of the self-assembled monolayer 40.

Next, the hydroxyl group at the surface of the substrate 10 at the convex portion 35 is reacted by using at least one of trichlorosilane, dichloro-monomethylsilane, and monochloro-dimethylsilane, and each including a hydrophobic group. Here, the compounds, which have the hydrophobic group, form a strong covalent bond with the hydroxyl group of the surface of the convex portion 35. The degree of hydrophobicity of the surface of the substrate 10 at the convex portion 35 may be controlled through variation of the chain length of the alkyl group of the hydrophobic group included in the compound and the kind of functional group that is used.

As described above, according to an exemplary embodiment, when the hydrophilic self-assembled monolayer 40 is formed on the surface of the recess portion 30, the hydrophobic self-assembled monolayer 50 is formed on the surface of the convex portion 35. Contrarily, when the hydrophobic self-assembled monolayer 40 is formed on the surface of the recess portion 30, the hydrophilic self-assembled monolayer 50 is formed on the surface of the convex portion 35.

That is, as shown in FIG. 5, a printing substrate 55 is formed in which the surface of the recess portion 30 and the surface of the convex portion 35 are treated to have different energies.

The compounds having the hydrophilic group or hydrophobic group form a strong covalent bond with the hydroxyl group of the surface of the substrate 10 at recess portion 30 or the convex portion 35 such that the above-described self-assembled monolayers 40 and 50 are semi-permanent.

Figure 6:
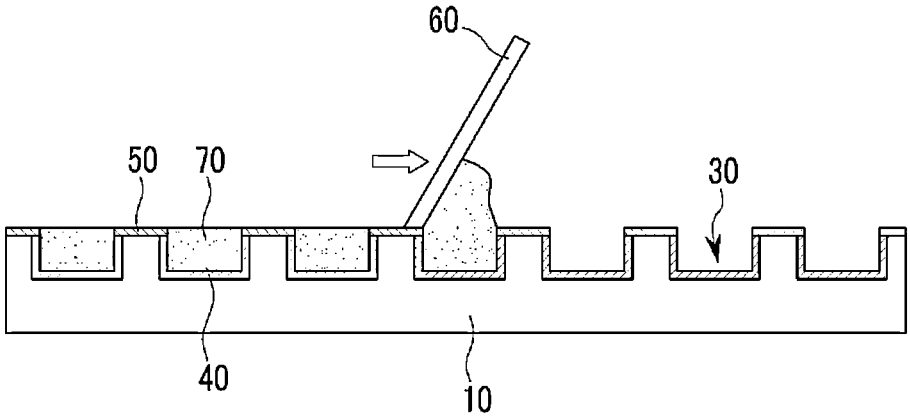

Referring to FIG. 6, the ink 70 is injected into the recess portion 40 of the printing substrate 55 according to an exemplary embodiment by using an ink injection device (not shown), and the ink is filled in the recess portion 40 by using a blade 60.

The blade 60 planarizes the ink that was filled into the recess portion 30 and simultaneously removes the ink from on top of the convex portion 35 through physical contact between the blade 60 and the printing substrate 55. Here, the ink used includes a polar solvent such as terpineol or butyl carbitol acetate (BCA). The ink used may include a non-polar solvent according to the characteristics of the solid component of the desired pattern.

As described above, the surface of the recess portion 30 and the surface of the convex portion 35 of the printing substrate 55 according to an exemplary embodiment are treated to have different energies. In detail, when the ink includes a polar solvent, a hydrophilic self-assembled monolayer is formed on the surface of the substrate at the recess portion 30, and a hydrophobic self-assembled monolayer is formed on the surface of the substrate 10 at convex portion 35. That is, the surface of the substrate 10 at the recess portion 30 is treated with the hydrophilic compound, and thereby has a high surface energy, and the surface of the substrate at the convex portion 35 is treated with the hydrophobic compound, thereby decreasing surface energy.

A strong interaction is generated between the hydrophilic layer formed on the surface of the recess portion 30 and the polar solvent of the ink such that the ink is easily filled inside the recess portion 30. At the same time, a strong repulsive force is generated between the hydrophobic layer and the polar solvent of the ink on the surface of the convex portion 35 such that the ink does not remain, and even if a portion of the ink does remain, it may be easily removed in the process of filling the ink into the recess portion 30 by using the blade 60. Also, at the interface of the recess portion 30 and the convex portion 35 the different surface energies suppress attraction, such that the accuracy of the printing pattern may be improved.

When the ink includes a non-polar solvent, a hydrophobic self-assembled monolayer is formed on the surface of the substrate 10 at the recess portion 30 and a hydrophilic self-assembled monolayer is formed on the surface of the substrate 10 at the convex portion 35.

A strong interaction is generated between the hydrophobic layer formed on the surface of the recess portion 30 and the non-polar solvent of the ink such that the ink is easily filled inside the recess portion 30. Further, a strong repulsive force is generated between the hydrophilic layer and the non-polar solvent of the ink at the surface of the convex portion 35, such that the ink does not remain, and even if a portion of the ink does remain, it may be easily removed in the process of filling the ink into the recess portion 30 by using the blade 60. Also, at the interface of the recess portion 30 and the convex portion 35 the different surface energies suppress attraction, such that the accuracy of the printing pattern may be improved.

Figure 7:
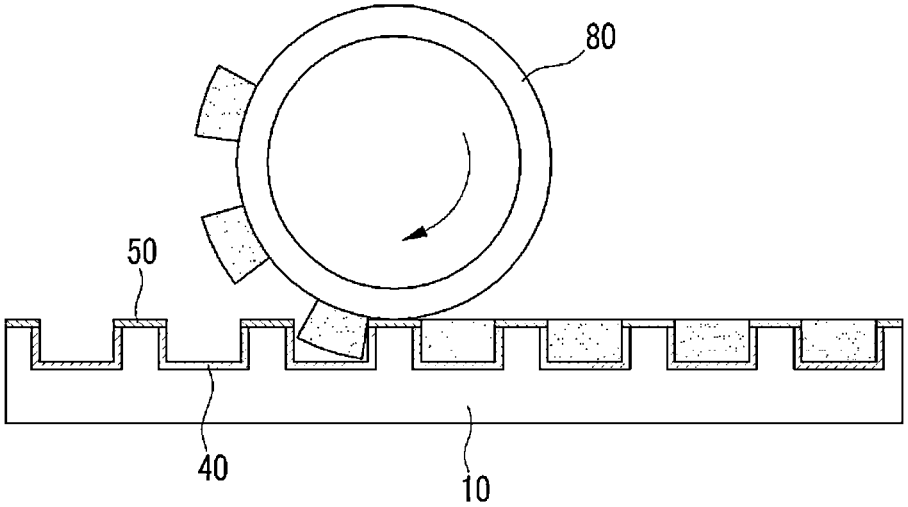

Referring to FIG. 7, a blanket 80 is brought close to and makes contact with the printing substrate 55 in which the recess portions 30 have been filled with ink, as described above. As the blanket 80 is moved, for instance, rolled, the ink that is in the recess portion 30 is transferred to the blanket 80.

Figure 8:
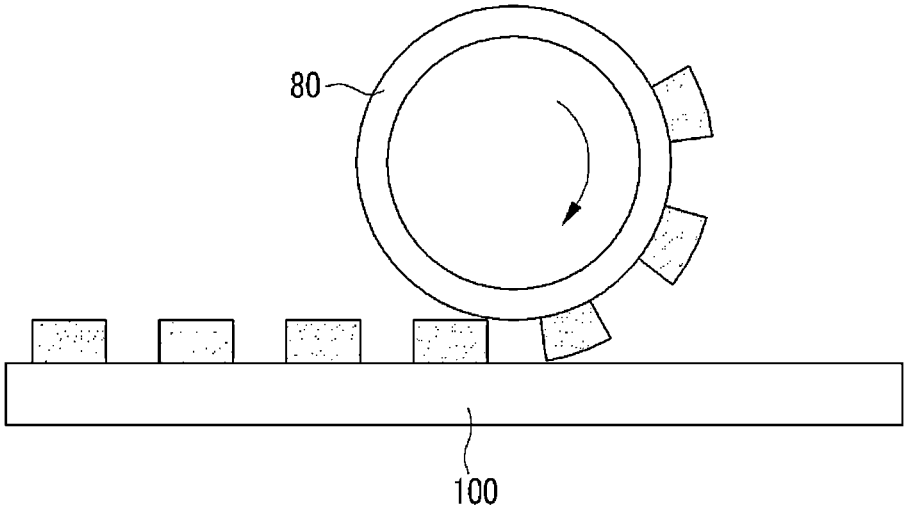

Referring to FIG. 8, the blanket 80 is brought in contact with a printing object substrate 100 and then moved, for instance, rolled, such that the ink transferred to the blanket 80 is printed to the printing object substrate 100.

Figure 9:
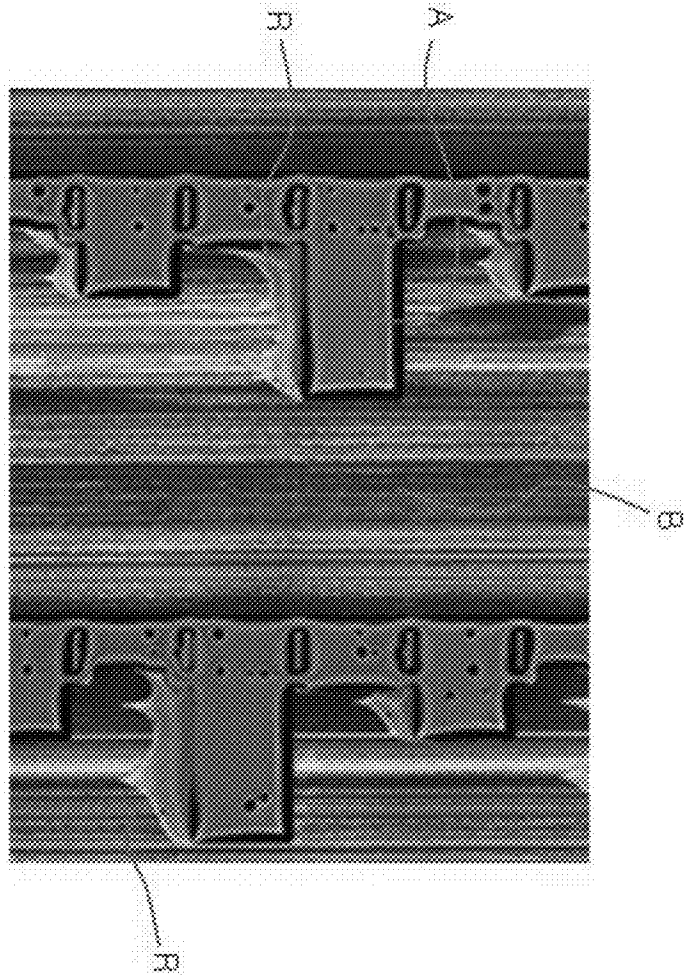
FIG. 9 is a photograph showing a state of ink injected into a recess portion of a printing substrate that is not treated to be hydrophobic or hydrophilic.

FIG. 9 is a photograph showing the state of ink injected into a recess portion, referred to as the concave pattern portion, A of a printing substrate that is not surface-treated to have hydrophobic or hydrophilic sections as described above. Ink residue R remains at the surface of the convex region B near the concave pattern portion A.

A printing substrate that is not surface-treated as described above has a water contact angle of about 30 to 50 degrees. Also, there is no surface energy difference between the concave pattern portion A and the convex region B, such that selectivity according to the difference of surface energies is not generated when coating the ink on the printing substrate surface. Accordingly, when filling the ink into the concave pattern portion A of the printing substrate by using a blade, attraction of the ink is generated by the interaction between the solution component and the solid component such that residue remains at the convex region B of the printing substrate. As a result, the ink portion remaining on the convex region B may be transferred to the blanket due to the attraction, and the residual ink is transferred to the printing object substrate, thereby affecting the accuracy of the pattern that is printed. Also, when the ink remains in the convex region B and is hardened, it is difficult to remove the remaining ink, which causes problems in a continuous printing process.

Figure 10:
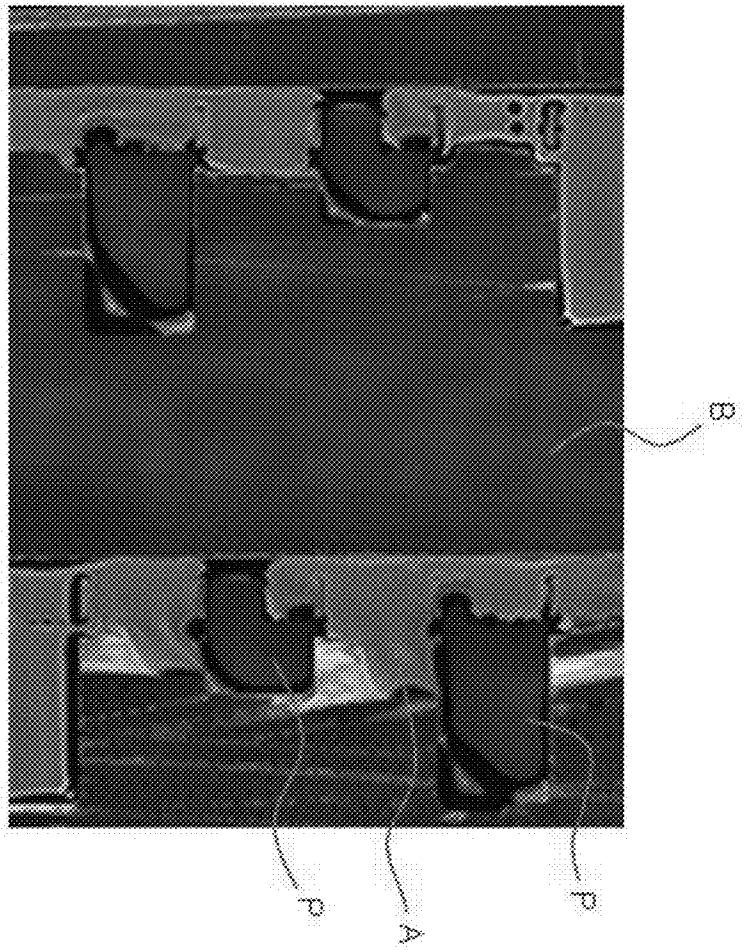
FIG. 10 is a photograph showing a state of ink injected into a recess portion of a printing substrate that is treated to be hydrophobic.

FIG. 10 is a photograph showing the state of ink injected into a concave pattern portion A of a printing substrate that is treated to be hydrophobic.

In FIG. 10, the entire surface of the printing substrate was manufactured to be hydrophobic by treating the surface with the hydrophobic compound polydimethylsiloxane (PDMS). The surface treatment includes treating the surface of the printing substrate with UV/$O_3$, dipping the printing substrate in aminopropyltriethoxysilane solution with 0.5% in $H_2O$ at room temperature for one hour, washing the printing substrate with $H_2O$ and IPA (Isopropyl alcohol), dipping the printing substrate in oxirane functionalized PDMS solution at 70 degrees for two hours, and washing the printing substrate with IPA.

As a result, a water contact angle of more than 80 degrees is formed, and the surface energy is reduced. FIG. 10 shows that the ink, which in this case includes a solid component of silver (Ag), is filled in the concave pattern portion A of the printing substrate by using the blade.

As shown in FIG. 10, the ink can be easily removed from the convex region B of the printing substrate because of the strong repulsive force between the ink, which includes the polar solvent, and the hydrophobic surface. Also, the attraction of the ink is remarkably decreased in the interface between the concave pattern portion A and the convex region B. However, a region P where the ink does not completely fill the concave pattern portion is generated by the repulsive force between the ink and the surface in the concave pattern portion A. As a result, a non-printing region may be generated and the accuracy of the printing pattern may be deteriorated.

However, according to an exemplary embodiment, the concave pattern portion and the convex region are surface-treated to have different surface energies, such that the ink non-filling of the concave pattern portion and the ink residue of the convex region may be prevented.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A gravure printing method comprising:

patterning a substrate to form a printing substrate having a recess portion and a convex portion;

forming a first, hydrophilic, self-assembled monolayer on the surface of the recess portion;

forming a second, hydrophobic, self-assembled monolayer on the surface of the convex portion;

filling the recess portion with an ink, wherein the ink includes a polar solvent; and transferring the ink in the recess portion onto a printing object substrate, wherein an attractive force is generated between the first, hydrophilic, self-assembled monolayer and the polar solvent attracting the ink into the recess portion to fill the recess portion with the ink, and a repulsive force is generated between the second, hydrophobic, self-assembled monolayer and the polar solvent repelling the ink from the surface of the convex portion.

2. The gravure printing method of claim 1, wherein the forming of the first self-assembled monolayer comprises:

forming a first hydroxyl group on the surface of the recess portion, and combining the first hydroxyl group and a compound including a hydrophilic group; and the forming of the second self-assembled monolayer comprises:

forming a second hydroxyl group on the surface of the convex portion, and combining the second hydroxyl group and a compound including a hydrophobic group.

3. The gravure printing method of claim 2, wherein: the forming of the first hydroxyl group comprises using one of UV (ultraviolet)/ozone, plasma, a basic solution, and an acidic solution; and the forming of the second hydroxyl group comprises using a basic solution.

4. The gravure printing method of claim 3, wherein the compound comprising the hydrophilic group includes at least one of trichlorosilane, dichloro-monomethylsilane, monochloro-dimethylsilane substituted with the hydrophilic group, and the hydrophilic group including at least one of a glycol, an alcohol, and an amine, and the compound including the hydrophobic group comprises at least one of trichlorosilane, dichloro-monomethylsilane, and monochloro-dimethylsilane substituted with the hydrophobic group, and the hydrophobic group including an alkyl or aromatic group.

5. The gravure printing method of claim 1, wherein the forming of the first self-assembled monolayer comprises:

forming a first hydroxyl group on the surface of the recess portion; and combining the first hydroxyl group and a compound including a hydrophobic group; and the forming of the second self-assembled monolayer comprises:

forming a second hydroxyl group on the surface of the convex portion, and combining the second hydroxyl group and a compound including a hydrophilic group.

6. The gravure printing method of claim 5, wherein the ink comprises a non-polar solvent.

7. The gravure printing method of claim 6, wherein the forming of the first hydroxyl group comprises using one of UV (ultraviolet)/ozone, plasma, a basic solution, and an acidic solution, and the forming of the second hydroxyl group comprises using a basic solution.

8. The gravure printing method of claim 7, wherein the compound including the hydrophilic group comprises at least one of trichlorosilane, dichloro-monomethylsilane, and monochloro-dimethylsilane substituted with the hydrophilic group, and the hydrophilic group including at least one of a glycol, an alcohol, and an amine, and the compound including the hydrophobic group comprises at least one of trichlorosilane, dichloro-monomethylsilane, and monochloro-dimethylsilane substituted with the hydrophobic group, and the hydrophobic group including an alkyl or aromatic group.

9. The gravure printing method of claim 1, wherein the patterning of the substrate to form the printing substrate comprises forming a photoresist pattern on a portion of the substrate corresponding to the convex portion.

10. The gravure printing method of claim 9, wherein the forming of the first self-assembled monolayer is executed in a state in which the photoresist pattern is in contact with the substrate.

11. The gravure printing method of claim 1, wherein the filling the recess portion with the ink comprises:

injecting the ink into the recess portion; and removing the ink disposed on a region of the printing substrate other than the recess portion by using a blade.

12. The gravure printing method of claim 11, wherein the transferring of the ink in the recess portion to the printing object substrate comprises:

rotating a blanket at the surface of the printing substrate to transfer the ink in the recess portion to the blanket, and transferring the ink transferred to the blanket from the blanket to the printing object substrate.

13. The gravure printing method of claim 12, wherein the forming of the first self-assembled monolayer comprises:

forming a first hydroxyl group on the surface of the recess portion, and combining the first hydroxyl group and a compound including a hydrophilic group; and the forming of the second self-assembled monolayer comprises:

forming a second hydroxyl group on the surface of the convex portion; and combining the second hydroxyl group and the compound including a hydrophobic group.

14. The gravure printing method of claim 12, wherein the compound comprising the hydrophilic group comprises at least one of trichlorosilane, dichloro-monomethylsilane, and monochloro-dimethylsilane substituted with the hydrophilic group, the hydrophilic group including at least one of a glycol, an alcohol, and an amine, and the compound comprising the hydrophobic group comprises at least one of trichlorosilane, dichloro-monomethylsilane, and monochloro-dimethylsilane substituted with the hydrophobic group, the hydrophobic group including an alkyl or aromatic group.

15. The gravure printing method of claim 14, wherein the patterning of the substrate to form the printing substrate comprises forming a photoresist pattern on the portion of the substrate corresponding to the convex portion.

16. The gravure printing method of claim 15, wherein the forming of the first self-assembled monolayer is executed in a state in which the photoresist pattern is present on the substrate.

17. The gravure printing method of claim 2, wherein the ink comprises a non-polar solvent.

18. The gravure printing method of claim 17, wherein the forming of the first self-assembled monolayer comprises:

forming a first hydroxyl group on the surface of the recess portion, and combining the first hydroxyl group and a compound including a hydrophobic group; and the forming of the second self-assembled monolayer on the surface of the convex portion comprises:

forming a second hydroxyl group on the surface of the convex portion, and combining the second hydroxyl group and the compound including a hydrophilic group.

19. The gravure printing method of claim 18, wherein the compound including the hydrophilic group comprises at least one of trichlorosilane, dichloro-monomethylsilane, and monochloro-dimethylsilane substituted with the hydrophilic group, the hydrophilic group including at least one of a glycol, an alcohol, and an amine, and the compound including the hydrophobic group comprises at least one of trichlorosilane, dichloro-monomethylsilane, and monochloro-dimethylsilane substituted with the hydrophobic group, the hydrophilic group including an alkyl or aromatic group.

20. The gravure printing method of claim 19, wherein the patterning of the substrate to form the printing substrate comprises forming a photoresist pattern on a portion of the substrate corresponding to the convex portion.

21. The gravure printing method of claim 20, wherein the forming of the first self-assembled monolayer is executed in a state in which the photoresist pattern is present on the substrate.

* * * * *